United States Patent [19]

Saeki

[11] 4,219,123

[45] Aug. 26, 1980

[54] COUPLER FOR TOY AND MODEL RAILWAY CARS

[75] Inventor: Jiro Saeki, Tokyo, Japan

[73] Assignee: Tomy Kogyo Co. Inc., Tokyo, Japan

[21] Appl. No.: 847,430

[22] Filed: Nov. 1, 1977

[51] Int. Cl.[3] ..... B61G 1/08; A63H 19/00

[52] U.S. Cl. ..... 213/75 TC; 213/211

[58] Field of Search ..... 213/75 A, 75 R, 75 TC, 213/75 D, 211, 212; 46/216, 217; 335/207, 306; 104/147 A, DIG. 1

[56] References Cited

U.S. PATENT DOCUMENTS

| | | | |
|---|---|---|---|
| 142,815 | 9/1873 | Replogle | 213/175 |
| 1,493,275 | 5/1924 | Pons | 335/207 |
| 3,840,127 | 10/1974 | Edwards et al. | 213/75 TC |

*Primary Examiner*—George E. A. Halvosa

*Attorney, Agent, or Firm*—George A. Loud

[57] ABSTRACT

A coupler for toy and model railway cars includes a coupler knuckle adapted to engage a complimentary knuckle on an adjacent car. The knuckle is pivotally mounted and is adapted to pivot between a lower position substantially parallel to a trackway and an upper position. A first permanent magnet is mounted on the knuckle and a second magnet is mounted on the car structure with an unlike pole facing the adjacent pole of the first magnet. The resultant magnetic attraction between the unlike poles resiliently urges the knuckle to the lower position. Cars may be uncoupled by providing an uncoupling magnet on the trackway to attract one pole and repel the other pole of the first magnet to create an attraction/repulsion force couple to torque the knuckle to the upper position and thereby uncouple adjacent cars.

12 Claims, 8 Drawing Figures

COUPLER FOR TOY AND MODEL RAILWAY CARS

BACKGROUND OF THE INVENTION

1. Field of the Invention

The present invention relates to coupler mechanisms for toy and model railway cars, or the like, and more particularly, to couplers utilizing magnetic means for coupling and uncoupling.

2. Prior Art

Toy and model railway cars utilize coupler mechanisms located at the ends of each car to affect the coupling and uncoupling of adjacent cars. Ordinary couplers mechanisms have been characterized by troublesome and unreliable operation giving rise to a need, especially with regard to the smaller scale model railroad couplers, for a simple inexpensive coupler which provides reliable coupling and uncoupling. Examples of conventional coupler mechanisms include the so-called "Arnold-type" shown in FIGS. 1 and 2, and a coupler mechanism disclosed in U.S. Pat. No. 3,840,127 to Edwards.

The "Arnold-type" coupler, generally referred to in FIGS. 1 and 2 by the reference character 10, includes a "C"-shaped coupler knuckle 11 secured to an end of a support shaft 12 and a flange 13 formed at and extending laterally outward of the other end of the shaft 12. The knuckle 11 includes a triangular formation 19 at its forward end having upper and lower inclined ramp surfaces. The flange end of the support shaft 12 is pivotally retained in a pocket 21 formed in a support means 15 secured to the end of the car 14 (broken line illustration). The flange 13 is resiliently urged by a helical coil spring 17, in compression, against a forward wall 18 of the support means 15. The knuckle 11 is mounted so that it may pivot in a vertical plane between a lower position substantially parallel to a trackway 20 and an upper position (FIG. 2) with the spring 17 resiliently urging the knuckle 11 to the lower position. In order to couple adjacent cars together, the cars are thrust towards one another causing one of the two knuckles to ride upwardly on the upper inclined ramp surface of the other knuckle. In the case shown in FIG. 2, the knuckle 11 is forced to its upper position by the upper inclined ramp surface of the knuckle 11'. The upwardly pivoted knuckle 11 then clears the horizontal knuckle 11' and is resiliently urged by the spring 17 to the lower position to engage the knuckle 11'. The cars may be readily uncoupled by providing a depending pin, 16 and 16', on each knuckle, 11 and 11', and an uncoupling means 22 which may be selectively caused to extend upward from the trackway 20 to contact one of the depending pins and force the associated knuckle to its upper position to disengage the knuckles and thereby uncouple the cars.

A disadvantage of the above described coupler is that the spring 17 can twist and thereby diminish the ability of the spring to maintain the knuckles 11 and 11' in their normal positions. As a result, the coupler operation is less than reliable. In addition, it has proven extremely difficult to control the running and stopping of the cars in such a manner to effect reliable uncoupling.

The coupling mechanism disclosed in the aforementioned Edwards' patent affixes a permanent magnet to the knuckle of a conventional coupler to provide a means for magnetically uncoupling cars. The permanent magnet is aligned on the knuckle with its polar axis along the vertical and with one pole facing downward toward a trackway. An uncoupling electromagnet is located beneath the trackway with a like pole on the trackway facing upwardly toward the downwardly facing pole of the knuckle magnet. The cars are coupled as described above for the "Arnold-type" coupler and may be uncoupled by selectively energizing the uncoupling electromagnetic to cause a resultant magnetic repulsion between the like poles of the magnets to pivot one of the knuckles to its upper position and thereby effect uncoupling. The direction of the lines of force between the two magnets varies as the coupler pivots upwardly, as a result, the repulsion force differs depending upon the relative position of the two magnets. This force variation makes smooth and reliable uncoupling uncertain.

SUMMARY OF THE INVENTION

It is an object of the present invention to provide a coupler mechanism for coupling and uncoupling toy and model railway cars, or the like, which is reliable and operates with a smooth uniform motion.

It is another object of the present invention to provide a coupler which utilizes magnetic force to resiliently urge a coupler knuckler to a lower position substantially parallel to a trackway.

It is still another object of the present invention to provide a coupler utilizing magnetic force for both resiliently urging a coupler knuckle to a lower position and to effect the uncoupling operation.

Toward the fulfillment of these objects, and others, the present invention provides a coupler for connecting adjacent toy or model railway cars including a coupler knuckle having a first permanent magnet. A support means is provided at the end of a car upon which the knuckle is mounted to permit the knuckle to pivot between a lower position substantially parallel to a trackway and an upper position. A second magnet is mounted on a stationary structure relative the first magnet with an unlike pole of the second magnet facing a pole of the first magnet with the resultant magnetic attraction between the unlike poles resiliently urging the knuckle to the lower position.

Cars may be selectively uncoupled by mounting the pole of an uncoupling magnet, such as an electromagnet, on the trackway with the uncoupling magnet pole unlike that of the pole of the first magnet facing the second magnet. The two poles attract one another to create a torque to pivot the knuckle to the upper position and thereby uncouple the cars.

DESCRIPTION OF THE FIGURES

The above description as well as the objects, features, and advantages, of the present invention will be more fully appreciated by reference to the following detailed description of presently preferred but nonetheless illustrated embodiments in accordance with the present invention, when taken in conjunction with the accompanying drawings wherein.

DESCRIPTION OF THE PREFERRED EMBODIMENTS

Figure 1:
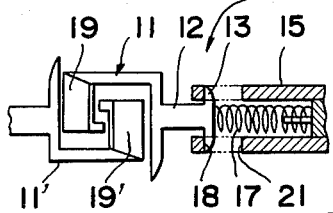
FIG. 1 is a plan view, in partial cross section, of a conventional coupler mechanism.
Figure 2:
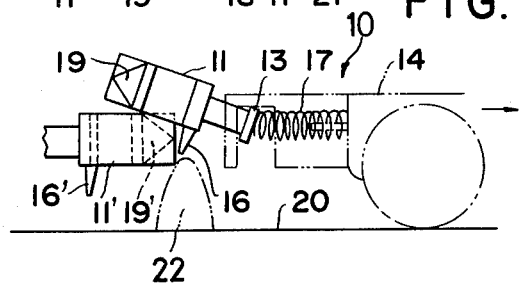
FIG. 2 is a side elevation view of the coupler shown in FIG. 1 with a coupler knuckle shown in an upward position and selected portions shown in broken line illustration.
Figure 3:
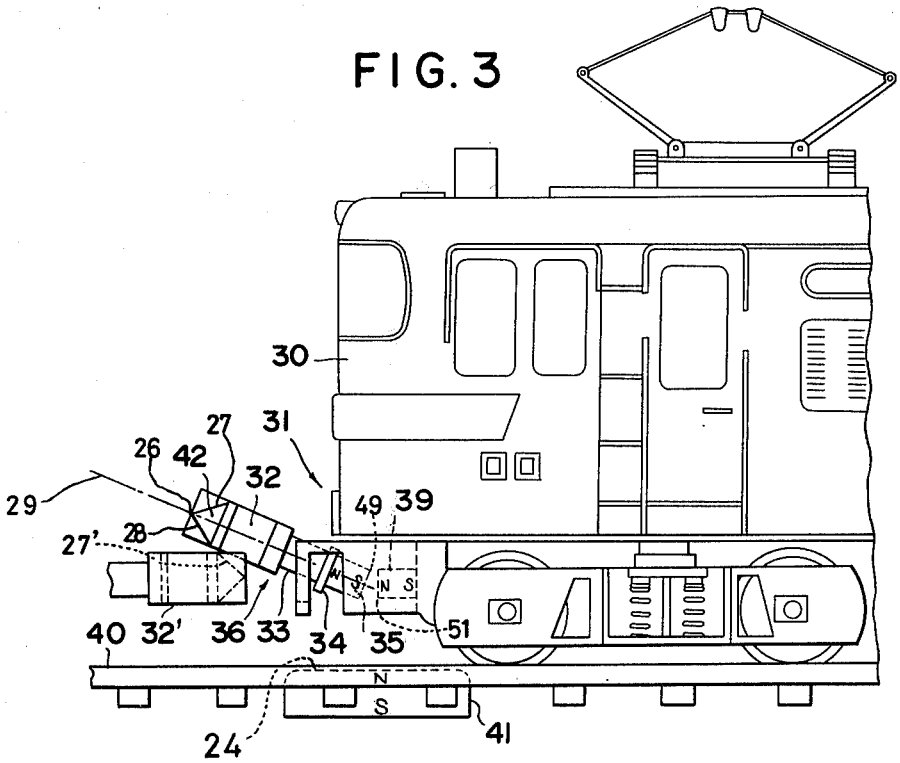
FIG. 3 is a side elevation view of a model railway car having a coupler embodying the present invention secured thereto with the coupler knuckle shown in an upward position.
Figure 4A:
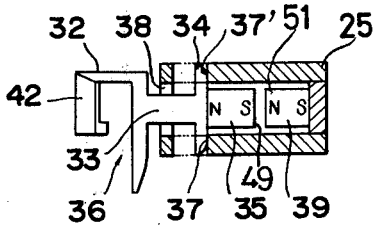
FIG. 4*a* is a plan view, in partial cross section, of the coupler shown in FIG. 3.
Figure 4B:
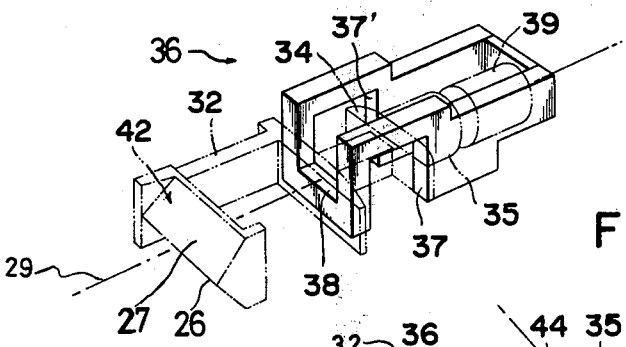
FIG. 4*b* is a perspective view of the coupler shown in FIG. 4*a* with selected portions shown in broken line illustration.

Referring to FIGS. 3, 4*a*, and 4*b*, the reference character 36 refers in general to a coupler of the present invention mounted at the end portion 31 of a model railway car 30. The coupler 36 is formed generally along a longitudinal axis 29 and includes a conventional coupler knuckle 32 secured to one end of a support shaft 33. The knuckle 32, which is adapted to engage a complimentary knuckle 32' on an adjacent car (not shown) includes a triangular formation 42 having inclined upper and lower ramp surfaces, 27 and 28, intersecting along a line 26. A flane 34 is formed at and extends laterally outward of the other end of the support shaft 33. The flange end of the coupler 36 is pivotally retained in a pocket 38 (FIG. 4*a*) of a support structure 25 having open front and upper portions and having spaced apart vertical walls 37 and 37'. The coupler 36 is pivotally supported for movement between a lower position substantially parallel to a trackway 40 and an upper position (FIG. 3).

A permanent magnet 35, preferably in the form of a bar magnet having a rectangular or circular cross section, is secured to the flange end of the support shaft 33 with its polar axis preferably coincident with the longitudinal axis 29 of the coupler 36.

A second permanent magnet 39, preferably having the same general shape as the magnet 35, is secured to the support structure 25 with one of its poles 51 facing towards a pole 49 of the magnet 35. The magnet 39 is preferably located on the support structure 25 such that its polar axis is substantially coincident with the longitudinal axis 29 of the coupler 36 when the coupler 36 is in its lower position.

The magnets 35 and 39 are so oriented that unlike poles face toward one another. In the case of the preferred embodiment shown in FIGS. 3 and 4*a*, the south pole of the magnet 35 faces the north pole of the magnet 39. As can be readily appreciated, a reverse polar arrangement is equally satisfactory. The magnetic attraction that results between the unlike poles of the magnets 35 and 39 causes the flange end of the shaft 33 to be resiliently urged against the ends of the walls 37 and 37' and thereby cause the knuckle 32 to be resiliently urged to its lower position.

Two cars utilizing the structure described above may be coupled together by thrusting the cars toward one another as shown in FIG. 3. As shown therein, the knuckle 32 is driven upward on the upper inclined ramp 27' of the other knuckle 32' to its upper position and then resiliently urged by the magnetic force between the magnets 35 and 39 to its lower position to thereby couple the cars.

The cars may be uncoupled by means of an uncoupling magnet 41 (FIG. 3), either a permanent magnet or a selectively actuable electromagnet, mounted beneath the trackway 40. The uncoupling magnet 41 is so mounted that one of its poles 24 is located on the trackway 40 facing upwardly toward the pole 49 of the magnet 35. The uncoupling magnet 41 is so oriented that the pole 24 is unlike the pole 49 of the magnet 35 and produces a substantially stronger magnetic force, that is, a substantially greater magnetic flux, than the magnet 39. In the preferred embodiment shown in FIG. 3, the pole 24 is a north pole. When it is desired to uncouple cars, they are rolled over the magnet 41 which is then energized by conventional electrical circuitry (not shown). As a result, the north pole 24 attracts the south pole 49 and repels the north pole of the magnet 35 to generate an attraction/repulsion force couple at the flange end of the coupler 36 which torques the coupler 36 upward to its upper position as shown in FIG. 3 to thereby uncouple the cars.

Figure 4C:
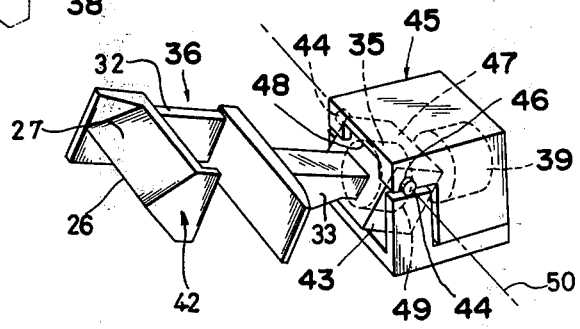
FIG. 4*c* is a perspective view of another coupler embodying the present invention, shown with the coupler knuckle in an upward position.

An alternate structure for supporting the coupler knuckle 32 is shown in FIG. 4*c* and includes a box-like receptacle 43 formed at the end of the support shaft 33 and into which the magnet 35 is inserted. Shafts 44 extend laterally outward from each side of the receptacle 43 along a lateral axis 50 and are received in bores 46 formed in the sidewalls of a support 45. The bores 46 are preferably enlarged to permit limited pivoting of the knuckle 32 in a plane passing through the lateral axis 50. When the coupler 36 is in its lower position, an upper wall 47 of the receptacle 43 contacts a ceiling 48 of the support 45 to limit the downward pivoting of the coupler 36 and thereby define the lower position of the coupler 36. This alternate embodiment permits the coupler 36 to pivot between its lower and upper positions in a smooth uniform manner when compared to the embodiment utilizing the aforementioned pivoting flange structure.

In the embodiments described above, both poles of the magnet 35 are located on one side of the pivoting axis of the coupler 36. During the uncoupling operation, the outwardly facing south pole 49 of the magnet 35 is attracted to the north pole 24 of the uncoupling magnet 41 to provide a torque to pivot the coupler to its upper position, and the north pole of the magnet is repelled by the north pole 24 to provide a counter-torque to pivot the coupler downward to its lower position. Since the north pole of the magnet 35 is closer to the pivoting axis, the counter-torque produced by the repulsion force is small and can be considered negligible.

Figure 5:
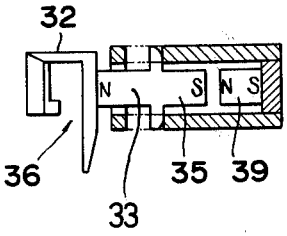
FIG. 5 is a plan view, in partial cross section, of a variation of the coupler shown in FIG. 4*a*.
Figure 6:
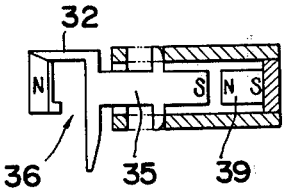
FIG. 6 is a plan view, in partial cross section, of another variation of the coupler shown in FIG. 4*a*.

It is readily possible to increase the attraction/repulsion force couple acting on the coupler 36 by having one pole of the magnet 35 on one side of the pivoting axis and the other pole on the other side of the pivoting axis. In FIG. 5 the support shaft 33 is formed as a magnetic member with one pole, the south pole, facing outwardly toward the magnet 39 and the other pole, the north pole, at the other end of the support shaft 33, contiguous with the knuckle 32. This embodiment may be fabricated by forming the support shaft 33 from a ferro-magnetic material or affixing a bar magnet to a support shaft 33 fabricated from a non-magnetic material. The embodiment shown in FIG. 6 is similar to that shown in FIG. 5, except that the north pole is located at the end of the knuckle 32. This embodiment may be fabricated by forming the knuckle 32 and the support shaft 33 as a unitary structure from a ferro-magnetic material. As can be appreciated, the attraction/repulsion force couple that results when the poles are on opposite sides of the pivoting axis is greater than that of the embodiments of FIGS. 4*a*, 4*b*, 4*c*.

The present invention provides a coupler for toy and model railway cars which is smooth and reliable in operation and which utilizes magnetic means to resiliently urge the coupler knuckle to the lower position and to uncouple cars in contrast to the prior art couplers. The present invention, while disclosed in a model railway cars context, is equally applicable to any kind of vertically pivotable coupling-uncoupling type coupler.

As will be apparent to those skilled in the art, various changes and modifications may be made to the couplers of the present invention without departing from the spirit and scope of the present invention as recited in the appended claims and their legal equivalent.

I claim:

1. A coupler for connecting toy railway cars comprising:

support means secured to an end of a car;

a coupler knuckle pivotally mounted on said support means for pivotal motion between a lower position in which the longitudinal axis of said coupler knuckle is substantially parallel to a track way and an upper position in which the longitudinal axis of said coupler knuckle is inclined relative to the trackway;

first magnet means carried by said coupler knuckle and having its polar axis alined substantially parallel to the trackway when the coupler knuckle is in its lower position; and second magnet means fixed on the car and positioned relative to said first magnet means to magnetically attract said first magnet means and to thereby urge said coupler knuckle to said lower position.

2. The coupler claimed in claim 1 wherein said knuckle has a lateral axis with bearing shafts extending laterally outward of said knuckle along said lateral axis; said support means having bores formed therein to pivotally receive said bearing shafts.

3. The coupler of claim 1 wherein said first magnet means extends longitudinally from said coupler knuckle toward the car.

4. The coupler of claim 3 wherein both poles of said first magnet means are located on the same side of the pivoting axis of the coupler knuckle.

5. The coupler of claim 3 wherein the two poles of said first magnet means are located on opposite sides of the pivoting axis of the coupler knuckle.

6. A coupler as defined by claim 1 and wherein the coupler knuckle is fabricated of ferro-magnetic material to provide said first magnet means.

7. The coupler of claim 1 wherein said first magnet means and said second magnet means are both permanent magnets.

8. The coupler claimed in claim 1, wherein said support means is adapted to support said knuckle for lateral pivoting.

9. A coupling/uncoupling apparatus for connecting and disconnecting toy railway cars comprising:

support means secured to an end of a car;

a coupler knuckle pivotally mounted on said support means for pivotal motion between a lower position in which the longitudinal axis of said coupler knuckle is substantially parallel to a trackway and an upper position in which the longitudinal axis of said coupler knuckle is inclined relative to the trackway;

first magnet means carried by said coupler knuckle and having its polar axis alined substantially parallel to the trackway when the coupler knuckle is in its lower position;

second magnet means fixed on the car and positioned relative to said first magnet means to magnetically attract said first magnet means and to thereby urge said coupler knuckle to said lower position; and an uncoupling magnet having a pole in the trackway, the pole in the trackway being opposite in polarity to the pole of said first magnet means facing said second magnet means, and having a substantially stronger magnetic flux than said second magnet means whereby a torque is created to pivot said coupler knuckle to said upper position.

10. The coupling/uncoupling apparatus of claim 9, wherein said uncoupling magnet comprises a selectively actuatable magnet.

11. The apparatus of claim 9, wherein said uncoupling magnet comprises a permanent magnet.

12. The apparatus of claim 9 wherein the poles of said first magnet are located on opposite sides of the pivoting axis of the coupler knuckle so that the repulsion force between the pole in the trackway and the like pole of said first magnet means increases said torque.

* * * * *